US005312263A

United States Patent [19]

Zapalski et al.

[11] Patent Number: 5,312,263

[45] Date of Patent: May 17, 1994

[54] REMOVABLE RADIO BEZEL CONNECTOR

[75] Inventors: Thomas A. Zapalski, Canton; Daniel C. Nagy, Farmington Hills, both of Mich.

[73] Assignee: Ford Motor Company, Dearborn, Mich.

[21] Appl. No.: 105,237

[22] Filed: Aug. 12, 1993

[51] Int. Cl.[5] ..... H01R 13/648; H01R 13/447

[52] U.S. Cl. ..... 439/181; 439/140

[58] Field of Search ..... 439/181, 186, 187, 140, 439/141, 92, 108

[56] References Cited

U.S. PATENT DOCUMENTS 5,002,495 3/1991 Tanaka ..... 439/181

5,185,804 2/1993 Watanabe ..... 381/86

FOREIGN PATENT DOCUMENTS 0253947 1/1987 European Pat. Off. .

2592846 7/1987 France .

*Primary Examiner*—Gary F. Paumen

*Attorney, Agent, or Firm*—Roger L. May; Mark L. Mollon

[57] ABSTRACT

A bezel connector for an electronic device in a vehicle, such as a radio, having a removable bezel. The bezel connector has a support member that is removably attached to the radio housing, and along with the other components of the connector form a removable module. The support member supports a PC board, which has connector pins protruding therefrom in spaced relationship. The connector pins are rigid and protrude from the PC board in a cantilever fashion. Also movably supported by the support member is a cover member having an electrically conducting portion. The cover member includes holes aligned with the connector pins to thereby shield and support the connector pins. Grounding springs bias the cover member in a position which selectively shields the connector pins and also provides an electrical connection between the cover member and the radio housing to discharge any static electricity charge that may be imparted to the cover member.

20 Claims, 2 Drawing Sheets

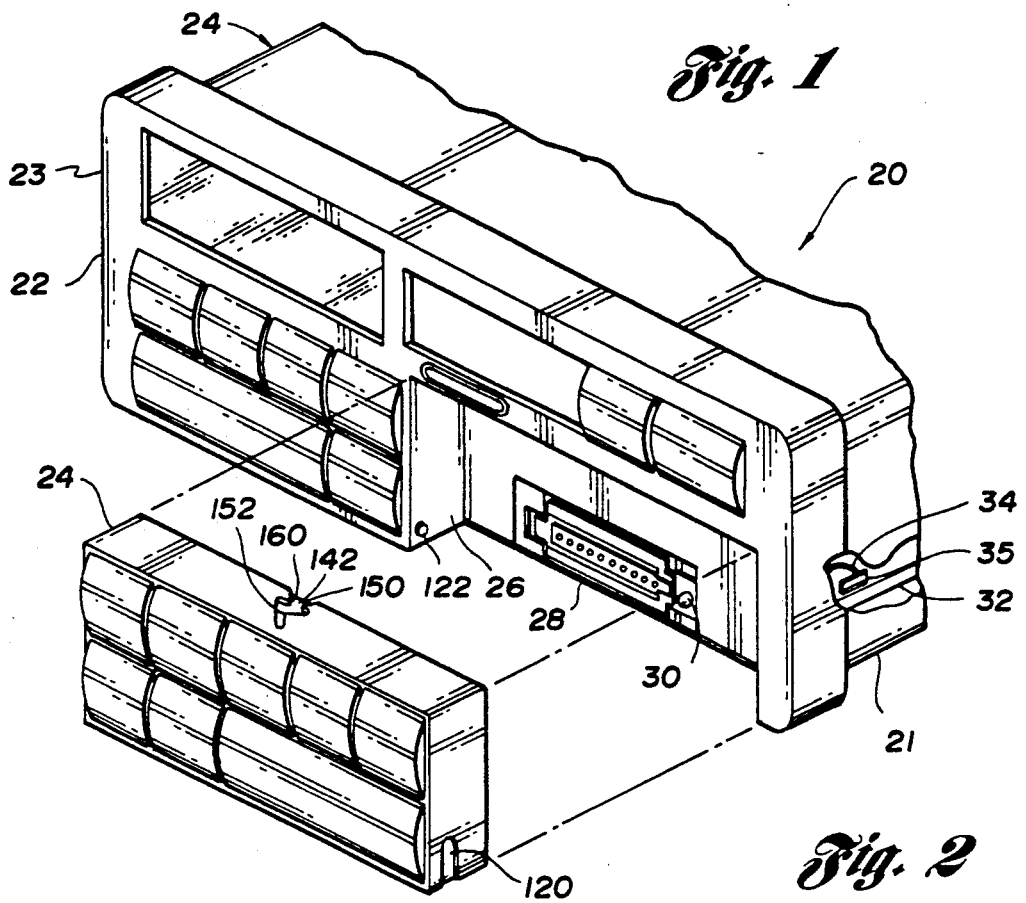
Fig. 1
Fig. 2
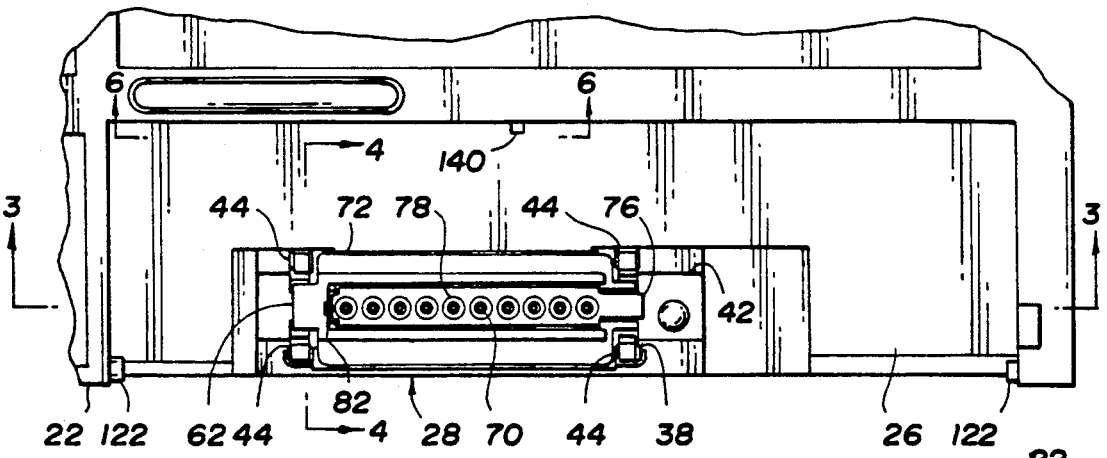
Fig. 3
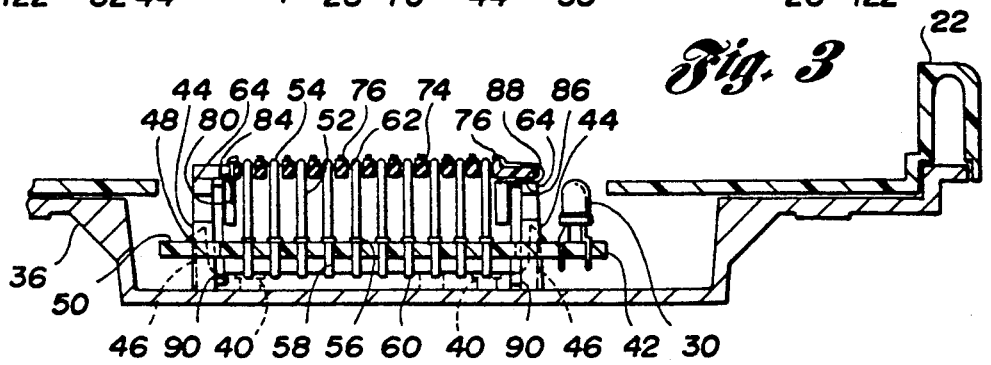

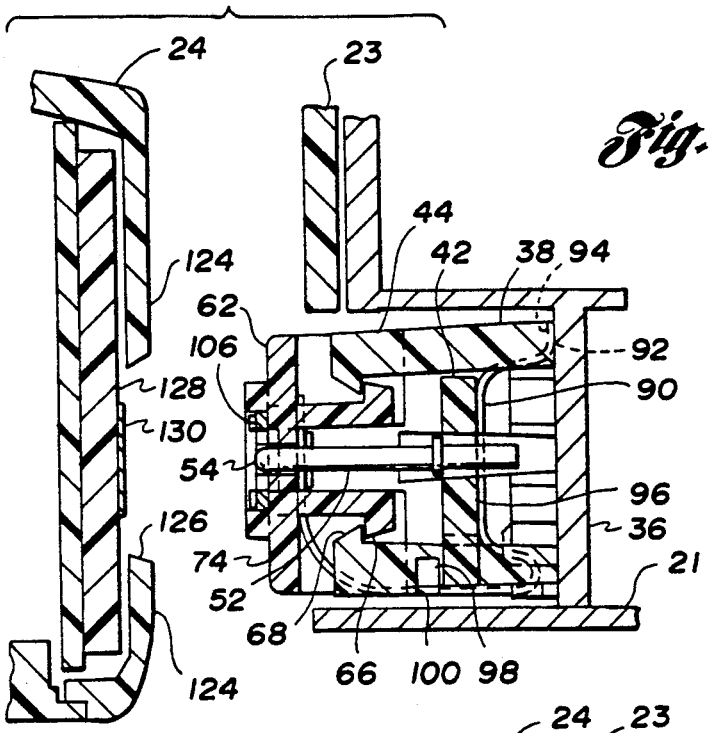
Fig. 4
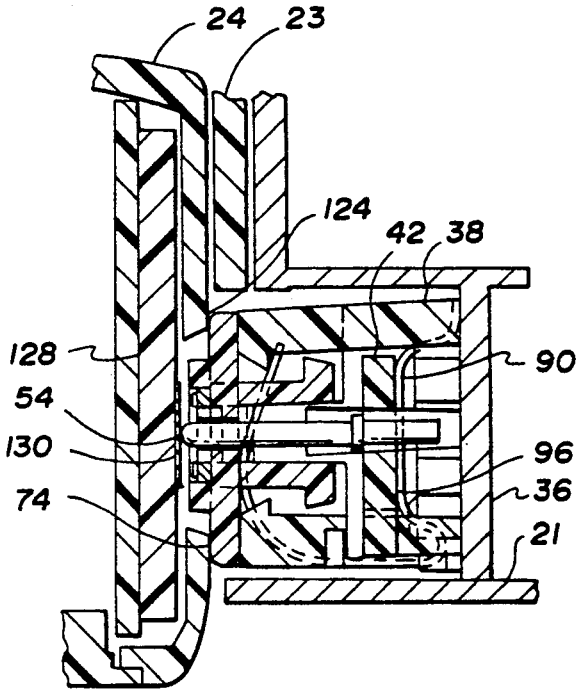
Fig. 5
Fig. 6
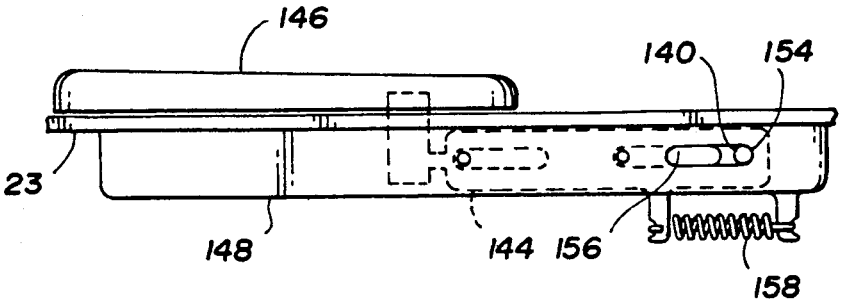

REMOVABLE RADIO BEZEL CONNECTOR

TECHNICAL FIELD

This invention relates to automotive radios and more particularly to automotive radios having removable bezels.

BACKGROUND ART

Vehicle radios are becoming more and more sophisticated and as a result more expensive. The radio, being mounted with its control panel (i.e., bezel) located visibly on the vehicle instrument panel, is an easy target for thieves. This has led to an increase in theft of car radios. Consequently, some vehicle radios are now designed to be rendered inoperative if stolen from a vehicle.

Typical measures taken to discourage thieves include rendering the radio inoperable in a visible manner. This can be done by providing a radio alarm or by allowing for removal of the entire radio when the vehicle operator leaves the vehicle. This can also be done by requiring the entry of a security code to get the unit to play. Additionally, thieves can be discouraged by allowing an occupant to remove the entire radio bezel when the operator leaves the vehicle so the car radio loses its appearance as a car radio. Further, some are designed such that an operator may remove only an essential portion of a bezel to render the radio inoperable. Removing only the bezel is easier than requiring the removal of the entire radio since the overall radio tends to be heavy and bulky; also, this does not require occupants to remember a security code.

More often, a removable radio bezel is preferred because it is small and light weight, which makes it easy to carry around. The removable portion of the bezel has contacts exposed on its back side that are electrically connected to the radio buttons on the front of the bezel. When referring to front and back herein, front refers to the side of the radio facing the occupant on the instrument panel of the vehicle, while back refers to the side of the radio that extends into the instrument panel of the vehicle. The electrical contacts on the bezel can be fabricated as a separate part affixed to the removable bezel circuit board or they can be integral with the removable bezel circuit board. The contacts maintain surface contact with connector pins, mounted within a recess to the fixed portion of the radio, when the removable portion of the bezel is installed into the radio. The buttons and knobs on the removable bezel will then be electrically connected to the connector pins. The connector pins, in turn, are electrically connected to the main circuit board of the radio.

In general, the pins are directly connected to the main radio circuit board, and, thus, cannot be easily replaced. One drawback with this arrangement is that if the pins are bent or broken, during the assembly or operation of the vehicle, and therefore need to be replaced, the entire radio must be replaced since it is not economical to replace just the main circuit board in the radio.

Another particular drawback with radios which have removable bezels is that the connectors present a difficulty with electrostatic discharge (i.e., static electricity). This arises because the pins are exposed when the bezel is removed and, thus, if an occupant of the vehicle contacts the pins while having a build up of static electricity, this static electricity will discharge to the connector pins. This surge of electricity from the discharge can permanently damage integrated circuits in the radio.

As a result, three techniques in particular have been developed to protect the radio from this problem. First, the pins can be electrically isolated from the components on the main circuit board using additional electrical components mounted to the main circuit board, to safeguard the components on the circuit board from the surge of static electricity. However, the additional electrical components on the main circuit board will increase the cost of parts and assembly for each radio.

A second technique uses a shield, made of a non-conductive material, such as plastic, that will completely cover the pins while the bezel is removed, and move out of the way when the bezel is installed. Nevertheless, this still does not eliminate the chance that the occupant will accidentally move the cover out of the way and contact the pins, especially since the shield is non-conductive plastic and will not ground the electrostatic discharge.

In a third technique, a grounded conductive shield is placed around the pins to absorb the static electricity and transmit it to ground rather than the circuit board. But, if the shield does not sufficiently cover the pins, the static electricity may still discharge to the pins. The shield must also be located such that it is not too close to the pins, so the electric discharge will not arc between the grounded shield and the pins. The difficulty arises because the shield must both cover the pins sufficiently to prevent the discharge or absorb it when the bezel is removed and also easily move out of the way when the bezel is inserted to allow the pins to come into and maintain surface contact with the contacts on the bezel.

A further drawback with the pins on some existing connectors concerns pin bending because the pins are thin, flexible strands of bent wire shaped to protrude from the connector in a triangular shape. These wires can be easily bent should they be mishandled either during assembly of the radio or by a user of the radio. Additionally, since the shields do not closely conform to the cross-sectional area of the bent wires, there is insufficient support to prevent the bending even though the shields may generally provide a guide for the wires.

The thin flexible wires also create an additional potential problem with static discharge if a person needs to straighten out the pins, once bent, and uses an electrically conductive instrument such as a screw driver. The person has to move the protective shield out of the way to straighten the pins and thus risks exposing the pins to static discharge.

DISCLOSURE OF INVENTION

The present invention contemplates a bezel connector for repeatedly disabling an electronic circuit in a device having a grounded housing mounted to a vehicle. The bezel connector is comprised of a support member mounted to the housing, and a connector circuit board adapted to be electrically connected to the electronic circuit, and mounted with respect to the support member. A plurality of connector pins extend from the connector circuit board and are spaced from each other. The connector pins are made of an electrically conductive material and are sufficiently rigid to resist bending. The bezel connector includes a cover member that is movably mounted with respect to the support member and the connector circuit board and has an electrically conductive portion. The electrically conductive portion is sufficiently exposed outside the device for discharging engagement with any potential static charge. The cover member is also provided with a plurality of openings, each opening reciprocally receiving one end of a respective connector pin in a sufficiently guiding and shielding relationship therewith, to continuously space the electrically conductive portion from the connector pins and to selectively shield the ends of the connector pins. The bezel connector further includes a spring made of an electrically conductive material. The spring electrically connects the housing to the electrically conductive portion of the cover member for grounding any static charge engaging the conductive portion. The spring further biasingly engages the cover member for selectively moving the cover member away from the connector circuit board for shielding the ends of the connector pins when the electronic circuit is disabled.

Accordingly, it is an object of the present invention to provide a bezel connector wherein the connector pins are made of an electrically conductive material sufficiently rigid to resist bending.

It is a further object of the present invention to provide a bezel connector with a module, including the support member, connector circuit board, connector pins, cover member and spring, mounted to a grounded housing rather than directly to the main circuit board; the connector circuit board being removably connectable to the electronic circuit, allowing easy removal and replacement of the bezel connector module as a unit should the connector pins become damaged.

It is still a further object of the present invention to provide a bezel connector with a module, including a connector circuit board and connector pins, removably mounted to a support member, thereby allowing easy removal and replacement of the module should the connector pins become damaged.

It is an additional object of the present invention to provide a bezel connector that provides shielding and support of the connector pins, the connector pins being substantially straight and rigidly mounted in the connector circuit board, with each opening of the cover member closely conforming to the cross-sectional configuration of a respective pin.

It is still further an object of the present invention to provide a bezel connector wherein a spring grounds the radio between the connector and the radio housing to eliminate the need for a separate grounding strap, the spring biases the cover for movement away from the connector circuit board to shield the ends of the connector pins, and the spring includes a portion biasingly engaging the connector circuit board for biasing the respective ends of the connector pins for reciprocal movement with respect to the openings in the cover member.

It is an advantage of the present invention to provide a bezel connector capable of sufficiently discharging static electricity to ground while shielding the connector pin from the static charge to allow a cost savings per radio by eliminating components on the main circuit board usually needed for electrical filtering between the connector pins and the main circuit board.

The foregoing and other objects, features and advantages of the present invention are readily apparent from the following detailed description of the best mode for carrying out the invention when taken in connection with the accompanying drawings.

BRIEF DESCRIPTION OF DRAWINGS

FIG. 1 is a perspective partial view of a radio with the removable portion of the bezel shown removed in accordance with the present invention;

FIG. 2 is a front partial view, on an enlarged scale, of the radio and the bezel connector, with the bezel not shown, in accordance with the present invention;

FIG. 3 is a sectional view taken along line 3—3 in FIG. 2;

FIG. 4 is a sectional view taken along line 4—4 in FIG. 2 with the removable portion of the bezel shown removed, in accordance with the present invention;

FIG. 5 is the same sectional view as FIG. 4 with the bezel mounted onto the radio; and FIG. 6 is a sectional view taken along line 6—6 in FIG. 2.

BEST MODES FOR CARRYING OUT THE INVENTION

The present invention relates to connectors for removable radio bezels that avoid problems associated with static discharge from a vehicle occupant, without the need to employ additional electrical components; and wherein the pins are sufficiently rigid to resist bending; and can easily be replaced if damaged without the need to replace the entire radio.

FIG. 1 illustrates a perspective view of a vehicle radio 20 having a bezel 22 with a standard fixed portion 23, mounted to the radio housing 21, and a removable portion 24 of the bezel, shown removed. The removable portion 24 is shaped to just fit into a recess 26 in the fixed portion 23. Located within the recess 26 is a bezel connector 28 that electrically connects the removable bezel 24 to the radio main circuit board 32. Also located in the recess 26 is a warning light 30, called an LED indicator, that is illuminated when the removable portion 24 is missing, to discourage a thief from even breaking into the vehicle when the removable portion 24 is removed.

The bezel connector 28 is shown in more detail in FIGS. 2–4. The bezel connector 28 removably mounts on a front casting 36 of the radio. The front casting 36 is made of an electrically conducting material and is grounded to the radio housing 21. The bezel connector 28 mounts using screws (not shown) through connector mounting holes 40 in a support member 38. The fasteners can be easily removed and the connector 28 can be easily replaced if it is damaged, rather than having the connector 28 permanently mounted to the main circuit board 32 within the radio 20. This is important since there is a small risk of damage to the pins if the radio 20 is mishandled.

The support member 38 mounts the connector to the front casting 36 as described above. The other components of the connector 28 are retained by the support member 38, which aligns the connector relative to the radio housing 21 and will assure alignment of connector pins when inserting the removable portion of the bezel 24. This arrangement of connecting all of the other components to the support member 38 in a modular fashion allows the connector to be assembled into the radio 20 and repaired as a single module.

Mounted to the support member 38 is a PC board 42. The PC board 42 is contained on its top and bottom by four corner support members 44 protruding from the support member 38 at its four corners. The PC board 42 is prevented from pulling away from the support member 38 by middle support members 46, protruding from either end of the support member 38. The middle support members 46 have barbs 48 that protrude through holes in the PC board 42 and engage the front surface 50 of the PC board 42. This allows the PC board 42 to be easily assembled to the support member 38 by merely pushing the PC board 42 towards the middle support members 46 until the barbs 48 snap through the holes in the PC board 42. The PC board 42, then, can also be easily removed by re-aligning the barbs with the holes in the PC board 42 while pulling the PC board away from the middle support members 46. The PC board 42 is electrically connected to the radio main circuit board 32 of the radio 20 by a flex circuit cable 34 that is soldered along the back (not shown) of the PC board 42 and has a connector 35 that attaches to plugs in the main circuit board when the bezel connector 28 is assembled into the radio 20, as shown in FIG. 1.

The connector pins 52 are generally cylindrical members each having a first end 54 that is rounded and also having a shoulder 56 extending radially from the pin 52 about midway between its ends. The connector pins 52 are made of an electrically conductive material. The PC board 42 has a plurality of bores 58 therethrough of substantially the same diameter as the pins 52. The second end 60 of each of the pins 52 is press fit into a respective bore 58 until the shoulder 56 abuts the front surface 50 of the PC board 42. Also, the cylindrical connector pins 52 are rigid, and therefore can have a greater diameter than flexible bent wire pins as used in the prior art, so they are not as likely to become bent if mishandled. However, if they should become bent, the pins 52 and PC board 42 can be removed and replaced as a module.

The corner support members 44 of the support member 38 also support a cover plate 62, made of a non-electrically conducting material such as plastic. The cover plate 62 has four mounting members 64 protruding from it, two spaced apart at each end. These mounting members 64 have barbs 66 protruding therefrom that engage barbs 68 on the support members 44, to retain the cover plate 62. The cover plate 62 also has a plurality of holes 70, one for each of the connector pins 52. Each hole 70 aligns with one of the pins 52, and helps to guide and support the pins 52. The holes 70 in the cover plate 62 are aligned along a recess 72 in the front face 74 of the cover plate 62. The recess 72 is shaped to nest a grounding plate 76 within it.

The grounding plate 76 is made of an electrically conductive material, and is designed to be able to take a 100,00 volt static charge and discharge it to ground. It also has a plurality of holes 78, each hole 78 is aligned with a corresponding connector pin 52. The holes 78 in the grounding plate 76 are concentric with and have a larger diameter than the holes 70 in the cover plate 62. This assures that the connector pins 52 remain spaced from the grounding plate 76 a sufficient distance to avoid having any static discharge jump from the grounding plate 76 to the pins 52.

A first end 80 of the grounding plate 76 is formed to slip into a cutout 82 in the cover plate 62. This first end 80 has a barb 84 that will retain the cover plate 62 against the grounding plate 76 when the first end 80 is inserted into the cutout 82. A second end 86 of the grounding plate 76 is formed to wrap around the end 88 of the cover plate 62 and secure the two parts together.

Two grounding and support springs 90 are contained in the bezel connector 28. A first end 92 of each engages a notch 94 in the support member 38, to retain and locate the springs 90, and also bias the first end 92 against the front casting 36. The springs 90 are made of an electrically conductive material. A portion of each of the springs 90 are in surface contact with the back side 96 of the PC board 42 and bias it forward against the barbs 48 in the support member 38. This locates the support sleeve 38, which, in turn, locates the connector pins 52. Also, the springs 90 each include a locating tab 98 that mates with a second notch 100 in the support member 38, to assure proper location of the springs 90 within the connector assembly 28.

The springs 90 are also each formed to have a second end 102 that maintains surface contact with and biases the back side 104 of the cover plate 62 forward. One of the two springs 90 is in actual surface contact with the cover plate 62; the other spring 90 is in surface contact with the grounding plate 76, thereby making an electrical connection between the grounding plate 76 and the front casting 36. In this way, no separate grounding strap is needed to transfer static electricity from the grounding plate 76 to the radio housing 21. The springs 90 press against the back side 104 of the cover plate 62 and bias the cover plate 62 forward until the barbs 68 on the support members 44 catch on the barbs 66 on the mounting members 64.

The springs 90, therefore, serve three functions; a ground for the grounding plate 76; biasing the PC board 42 against the cover plate 62; and supporting and biasing the cover plate 62 forward to conceal the connector pins 52.

FIG. 4 shows that the front face 74 of the cover plate 62 and the front face 106 of the grounding plate 76 will prevent an occupant from contacting the ends 54 of the connector pins 52. The cover plate 62 and grounding plate 76 will protrude farther forward than the connector pins 52. The grounding plate 76, then, will absorb any static discharge before a vehicle occupant can make contact with the connector pins 52, thereby shielding and protecting the connector pins 52 from possible static discharge. Therefore, the main circuit board will not need additional components to protect against any static electricity surges. The close encircling of the connector pins 52 about their cross-section by the cover plate 62 will also help to support the pins 52 and prevent bending, thus reducing the risk of a damaged connector.

FIGS. 1, 5 and 6 illustrate how the removable portion 24 of the bezel 22 inserts into the radio 20 and also how it electrically connects to the radio 20. The removable portion 24 of the bezel 22 has two slots 120 opening towards its bottom, one each at opposite ends. These slots 120 mate with integral pins 122, molded into the fixed portion of the bezel 22 within the recess 26, when the occupant first slides the bottom of the removable portion 24 down into the recess 26. The occupant then begins to push the top of the removable portion 24 back into the recess 26, rotating about the integral pins 122. At this point, two distinct operations are occurring.

First, as the removable portion 24 rotates back, the back 124 of the removable portion 24 begins pressing against the cover plate 62 on either side of the row of connector pins 52. Because there is a cutout 126 in the back 124 of the removable portion 24, the grounding plate 76 and the connector pins 52 do not contact the back 124. As the back 124 pushes against the cover plate 62, the portion of the two grounding and support springs 90 on the back side of the cover plate 62 flex, allowing the cover plate 62 to move back.

Within the removable portion 24 of the bezel 22 is a circuit board 128 that is electrically connected to the keys (not shown) on the front of the removable portion 24 of the bezel. The circuit board 128 has a row of electrical contacts 130 affixed to its back side, one each spaced to line up with a corresponding connector pin 52. As the cover plate 62 moves back to expose the shielded connector pins 52, the pins 52 begin to come into surface contact with the contacts 130. As the removable portion 24 moves into its final position, the contacts 130 will push against the pins 52. This causes the pins 52 to push back slightly on the PC board 42, flexing the portion of the springs 90 supporting the board 42. This portion of the springs 90, then, keeps the pins 52 biased against the contacts 130.

A second operation occurs as the top of the removable portion 24 is pushed back into the recess 26. A latch pin 140 begins to enter a groove 142 on top of the removable portion 24. The latch pin 142 is mounted upon a slidable plate 144 that is fixed to a bezel release lever 146 and is slidably attached to a latch plate 148, which is fixed relative to the radio 20. The latch pin 140 is biased by a spring 158 against a first end 154 of a slot 156 in the latch plate 148. As the removable portion 24 is pushed back, the latch pin 140 ramps up around the first catch 150, and then ramps up around the second catch 152. The removable portion 24 is now fully installed in the radio 20 and held in place by the second catch 152.

To remove the removable portion 24 of the bezel 22, the operator slides the bezel release lever 146 sideways against the bias of the spring 158. The pre-load in the two grounding springs 90 from installing the removable portion 24 will push it forward until the latch pin 140 catches on a third catch 160. The operator may then release the bezel release lever 146, and the latch pin 140 will slide over to nest in front of the first catch 150. The occupant may then grip the top of the removable portion 24 with his or her fingers and pull it out. The latch pin 140 will slip around the first catch 150. The purpose of the first 150 and third 160 catches is to assure that the potential for the removable portion 24 to pop out onto the floor of the vehicle is eliminated when the bezel release lever 146 is slid by the occupant.

As the occupant pulls the removable portion 24 out of the radio 20, the two grounding springs 90 push the cover plate 62 and grounding plate 76 forward, shielding the connector pins 52. This will prevent inadvertent contact between them and the occupants, thus protecting the pins from bending damage and static electricity discharge.

While the best mode for carrying out the invention has been described in detail, those familiar with the art to which this invention relates will recognize various alternative designs and embodiments for practicing the invention as defined by the following claims.

We claim:

1. A bezel connector for repeatedly disabling an electronic circuit in a device having a grounded housing mounted to a vehicle, the bezel connector comprising:

a support member mounted to the housing;

a connector circuit board adapted to be electrically connected to the electronic circuit and mounted with respect to the support member;

a plurality of connector pins extending from the connector circuit board and spaced from each other, the connector pins being made of an electrically conductive material sufficiently rigid to resist bending thereof;

a cover member movably mounted with respect to the support member and the connector circuit board and having an electrically conductive portion, the electrically conductive portion being sufficiently exposed outside the device for discharging engagement with any potential static charge, the cover member being provided with a plurality of openings, each opening reciprocally receiving one end of a respective connector pin in a sufficiently guiding and selectively shielding relationship therewith, to continuously space the electrically conductive portion from the connector pins and to selectively shield the ends of the connector pins; and electrically conductive means electrically connecting the housing to the electrically conductive portion of the cover member for grounding any static charge engaging the conductive portion and biasingly engaging the cover member for selectively moving the cover member away from the connector circuit board for shielding the ends of the connector pins when the electronic circuit is disabled.

2. The bezel connector of claim 1 wherein the connector circuit board is movably mounted with respect to the support member, and the electrically conductive means includes a portion biasingly engaging the connector circuit board for biasing the respective ends of the connector pins for reciprocal movement with respect to the openings in the cover member when the ends of the connector pins are not being shielded.

3. The bezel connector of claim 1 wherein the connector pins are substantially straight, have a predetermined cross-sectional configuration, are rigidly mounted in the connector circuit board and extend in cantilever fashion from one side of the connector board; and each opening of the cover member closely conforms to the cross-sectional configuration of a respective pin, to thereby continuously guide and support the pins when the cover member moves relative to the connector board.

4. The bezel connector of claim 1 wherein the support member, connector circuit board, connector pins, cover member, and electrically conductive means form a module, the module being removably mounted to the housing.

5. The bezel connector of claim 4 wherein the connector circuit board is removably connectable to the electronic circuit.

6. The bezel connector of claim 1 wherein the connector circuit board and connector pins form a module, the module being removably mounted to the housing.

7. The bezel connector of claim 1 wherein the connector circuit board is removably connectable to the electronic circuit.

8. The bezel connector of claim 1 wherein each of the plurality of connector pins has a cylindrical cross-section.

9. The bezel connector of claim 1 wherein the electrically conductive means comprises two support springs, each selectively moving the cover member away from the connector circuit board, and one of the two support springs electrically connecting the housing to the electrically conductive portion of the cover member.

10. A bezel connector for repeatedly disabling an electronic circuit in a device having a grounded housing mounted to a vehicle, the bezel connector comprising:

a support member mounted to the housing;

a connector circuit board adapted to be electrically connected to the electronic circuit and mounted with respect to the support member;

a plurality of connector pins extending from and rigidly mounted in the connector circuit board in a cantilever fashion and spaced from each other, the connector pins being made of an electrically conductive material sufficiently rigid to resist bending thereof, the connector pins being straight and having a predetermined cross-sectional configuration;

a cover member movably mounted with respect to the support member and the connector circuit board and having an electrically conductive portion, the electrically conductive portion being sufficiently exposed outside the device for discharging engagement with any potential static charge, the cover member being provided with a plurality of openings, each opening reciprocally receiving one end of a respective connector pin in a closely conforming relationship to the cross-sectional configuration of a respective pin to thereby sufficiently guide, support, selectively shield the ends of the connector pins when the cover member moves relative to the connector board, and to continuously space the electrically conductive portion from the connector pins; and means extending from one of the housing or the support member for selectively biasing the cover member for movement away from the connector circuit board for shielding the ends of the connector pins;

the means for biasing means including grounding means for electrically connecting the housing to the electrically conductive portion of the cover member for grounding any potential static charge.

11. The bezel connector of claim 10 wherein the grounding means is comprised of a grounding spring made of an electrically conductive material extending between the housing and the electrically conductive portion of the cover.

12. The bezel connector of claim 11 wherein the connector circuit board is movably mounted with respect to the support member, and the last named means includes a spring portion in biasing engagement with the connector circuit board for biasing the connector circuit board for movement away from the housing or the support member.

13. The bezel connector of claim 10 wherein the support member, connector circuit board, connector pins, cover member, and the last named means form a module, the module being removably mounted to the housing.

14. The bezel connector of claim 13 wherein the connector circuit board is removably connectable to the electronic circuit.

15. The bezel connector of claim 10 wherein the connector circuit board is removably connectable to the electronic circuit.

16. An electronic device for use in a vehicle comprising:

a grounded housing for enclosing an electronic circuit and adapted to be mounted to the vehicle;

a bezel having a removable portion for repeated removal from the housing for disabling the electronic device; and a bezel connector, for disabling the electronic circuit each time the removable portion is removed, the bezel connector having a support member mounted to the housing; a connector circuit board adapted to be electrically connected to the electronic circuit and mounted with respect to the support member; a plurality of connector pins extending from the connector circuit board and spaced from each other, the connector pins being made of an electrically conductive material sufficiently rigid to resist bending thereof; a cover member movably mounted with respect to the support member and the connector circuit board and having an electrically conductive portion, the electrically conductive portion being sufficiently exposed outside the device for discharging engagement with any potential static charge, the cover member being provided with a plurality of openings, each opening reciprocally receiving one end of a respective connector pin in a sufficiently guiding and concealing relationship therewith to continuously space the electrically conductive portion from the connector pins and to selectively shield the ends of said connector pins; and a spring made of an electrically conductive material, the spring electrically connecting the housing to the electrically conductive portion of the cover member for grounding any static charge engaging the conductive portion of the cover member and biasingly engaging the cover member for selectively moving the cover member away from the connector circuit board for shielding the ends of said connector pins each time the removable portion is removed.

17. The electronic device of claim 16 wherein the connector circuit board is movably mounted with respect to the support member, and the spring includes a portion in biasing engagement with the connector circuit board for biasing the respective ends of the connector pins for movement toward the removable portion when the removable portion is not removed.

18. The electronic device of claim 16 wherein the connector pins are substantially straight, have a predetermined cross-sectional configuration, are rigidly mounted in the connector circuit board and extend in cantilever fashion from one side of the connector board; and each opening of the cover member closely conforms to the cross-sectional configuration of a respective pin, to thereby continuously guide and support the pins when the cover member moves relative to the connector board.

19. The electronic device of claim 16 wherein the support member, connector circuit board, connector pins, cover member, and spring form a module, the module being removably mounted to the housing.

20. The electronic device of claim 16 wherein the connector circuit board is removably connectable to the electronic circuit.

* * * * *